United States Patent [19]

Mattei

[11] Patent Number: 4,883,074

[45] Date of Patent: Nov. 28, 1989

[54] STRIP GUIDE DEVICE, PARTICULARLY FOR A CIGARETTE MANUFACTURING MACHINE

[75] Inventor: Riccardo Mattei, Bologna, Italy

[73] Assignee: G.D Societa' per Azioni, Bologna, Italy

[21] Appl. No.: 16,217

[22] Filed: Feb. 19, 1987

[30] Foreign Application Priority Data

Feb. 28, 1986 [IT] Italy ..... 3345 A/86

[51] Int. Cl.[4] ..... A24C 5/04; A24C 5/20; A24C 5/31

[52] U.S. Cl. ..... 131/84.1

[58] Field of Search ..... 131/84.1, 84.3, 84.2, 131/84.4

[56] References Cited

U.S. PATENT DOCUMENTS 4,336,813 6/1982 Seragnoli ..... 131/84.3

*Primary Examiner*—V. Millin

*Attorney, Agent, or Firm*—Marshall, O'Toole, Gerstein, Murray & Bicknell

[57] ABSTRACT

A cigarette manufacturing machine having a horizontal bed, at least one belt for forming a continuous cigarette rod, the belt having a portion extending above and along the bed between a first and second end thereof, being movable along the bed towards the second end, and being wound about a suction rotary pulley arranged at the first end; a device for feeding a continuous stream of tobacco onto the belt portion, said tobacco feeding device extending above the first end and the pulley and defining between the stream of tobacco and the belt portion an input space for at least one paper strip; a paper strip guide device for feeding at least one paper strip onto the belt portion, the strip guide device having a device for feeding an end of the paper strip to the input space, and the paper feeding device having a plate for holding the end of the strip and designed to move between a first and a second position in which the plate is arranged away from, and respectively within, the input space.

7 Claims, 1 Drawing Sheet

STRIP GUIDE DEVICE, PARTICULARLY FOR A CIGARETTE MANUFACTURING MACHINE

BACKGROUND OF THE INVENTION

The present invention relates to a strip guide device, particularly for a cigarette manufacturing machine.

Cigarette manufacturing machines are known usually to comprise a feed unit inside which a paper strip, wound off a reel, is fed through a number of operating units on to a detour pulley about which the strip is wound and fed on to a horizontal bed. Between the said bed and the paper strip, there is located the top branch of a belt in the form of a loop and usually made of textile material permeable by air. In the proximity of the said detour pulley, the paper strip, moving along the horizontal bed together with the textile belt, is fed from above with a continuous stream of shredded tobacco from a feed device.

As it travels along the said bed, the paper strip is forced by the said belt to fold gradually crosswise, so as to form a continuous tobacco-filled cylinder generally referred to as a continuous cigarette rod, which is subsequently cut into single cigarette lengths.

In the event of the paper strip tearing upstream from the said detour pulley, during operation of the machine, a sensor, usually provided along the strip route, automatically shuts down the machine to enable the fault to be repaired by the operator.

Of the jobs the operator is required to perform for restarting the machine, one of the most complicated undoubtedly consists in rewinding the paper strip about the detour pulley and threading it through the extremely tight passage between the said bed and the end of the tobacco stream conveyor.

This operation, in itself difficult to perform on a single-rod cigarette manufacturing machine, is practically impossible on a dual-rod machine, i.e. designed to produce two parallel cigarette rods.

In the latter case, in fact, the paper strips are two in number and must be wound about respective pulleys coaxial with each other and located at the input end of the said rod forming bed. As a result, one of the said pulleys is concealed entirely by the other, thus preventing access by the operator.

In U.S. Pat. No. 4,336,813 filed by the present Applicant, G.D. S.p.A., insertion of the paper strips/s on to the rod forming bed is rendered automatic for overcoming the aforementioned drawback.

According to the said Patent, the cylindrical surface of the said detour pulley, which is located at the input end of the rod forming bed and constitutes a transmission member also for the said textile belt, is connected to a suction source.

According to the said Patent, the operator simply has to place the end of each paper strip on to the textile belt, at the point at which the said textile belt is wound about the detour pulley. When the machine is started up, the paper strip, held by suction on to the detour pulley, is fed by the same on to the said rod forming bed.

In actual practice, however, it has been found that, for the said operation to be performed successfully, and for feeding the strip correctly on to the rod forming bed, a sufficiently long portion of the strip must be arranged contacting the pulley, with the end of the strip already located on the horizontal rod forming bed. If not, when the machine is started up, the suction pulley fails to feed forward the strip, which is detached from the pulley due to the considerable drag created by means (transmission rollers and printing device) defining the strip route upstream from the pulley.

Consequently, when starting up the machine, especially each time the strip tears, the operator is required not only to arrange the end of the strip contacting the suction pulley, but also to insert the strip manually on to the bed through the said narrow passage.

This is obviously an extremely painstaking operation, especially on dual-rod cigarette manufacturing machines, on which one of the said two strips presents a route accessible only with difficulty by the operator.

SUMMARY OF THE INVENTION

The aim of the present invention is to provide a strip guide device designed to overcome the aforementioned drawbacks presented by the known state of the art, i.e. a device enabling paper strips to be fed rapidly and correctly into the input end of a continuous cigarette rod forming bed.

With this aim in view, according to the present invention, there is provided a strip guide device, particularly for a cigarette manufacturing machine, for feeding at least one paper strip on to a horizontal bed defined, at the top, by at least one belt for forming a continuous cigarette rod; which belt is wound, at the the input of the said bed, on to a pulley and located, at the said input, beneath a device for feeding a continuous stream of tobacco; characterised by the fact that it comprises a device for feeding the end of the said paper strip on to the said bed at the said input; the said feeding device comprising means for holding the said end of the said strip, and designed to move between a first position, wherein the said holding means are released in relation to the said input, and a second position wherein the said end of the said strip is inserted into the said input of the said bed.

BRIEF DESCRIPTION OF THE DRAWINGS

The present invention will be described, by way of example, with reference to the accompanying drawings, in which.

DETAILED DESCRIPTION OF THE INVENTION

Figure 1:
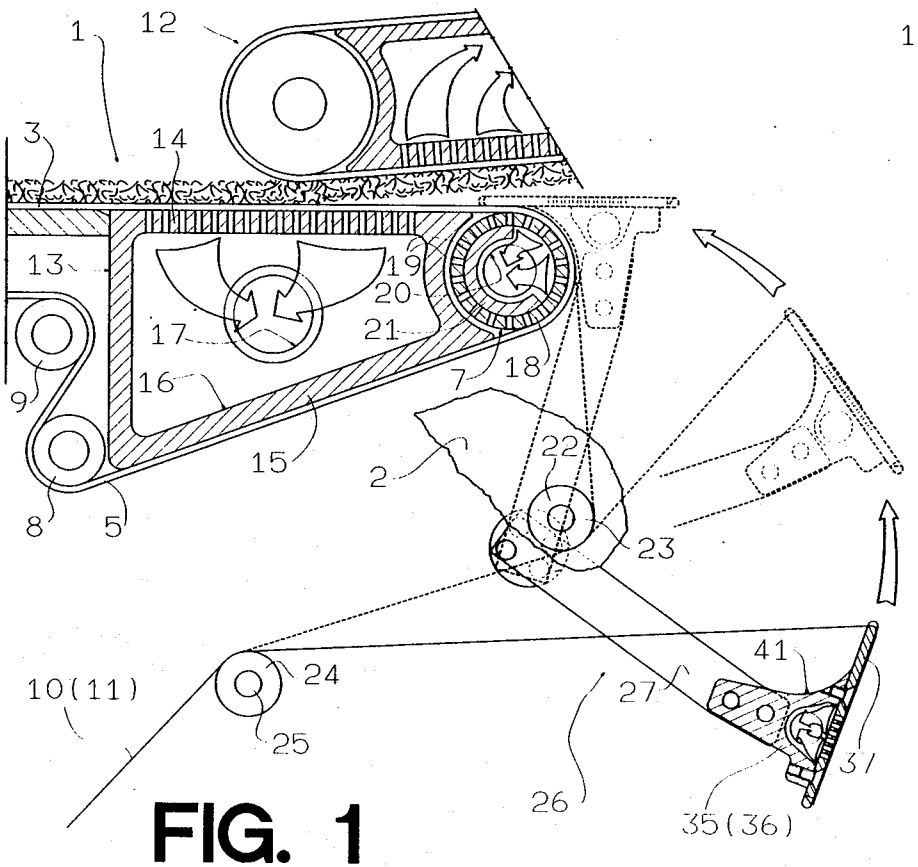
FIG. 1 shows a front view of the device according to the present invention.

FIG. 1 shows the input end of a bed 1 for forming continuous cigarette rods on a dual-rod cigarette manufacturing machine.

Bed 1 is secured substantially horizontally to a front wall 2 of the machine, and supports, in sliding manner, the top branches 3 and 4 (FIG. 2) of two conveyor belts 5 and 6 formed from material permeable by air.

At the input end of bed 1, belts 5 and 6 are looped about a horizontal pulley 7 and tensioned by transmission rollers 8 and 9.

The top branches 3 and 4 of belts 5 and 6 are designed to feed along the top surface of bed 1 two respective paper strips 10 and 11, on to each of which a continuous stream of shredded tobacco is fed by means of a known feed device indicated as a whole by 12.

The strip guide device according to the present invention comprises a box 13 located alongside pulley 7 and defined, at the top, by a punched horizontal wall 14 contacting top branches 3 and 4 of belts 5 and 6, and, at the bottom, by an inclined wall 15 contacting the portion of belts 5 and 6 between roller 8 and pulley 7.

Internally, box 13 defines a chamber 16 communicating with a suction source (not shown) via a duct 17.

Pulley 7, consisting of a tubular element 18 having a number of equally-spaced radial holes 19, is supported for rotation (in a manner not shown) by wall 2, and is turned about its axis by virtue of actuating means (not shown). Tubular element 18 defines a cylindrical chamber communicating externally via holes 19 and connected, via axial duct 20, to a suction source (not shown).

Tubular element 18 houses a fixed screening element 21 defined externally by a cylindrical surface extending coaxially with pulley 7 for an angle of substantially 180°. Screening element 21 cooperates, in airtight manner, with the half of the cylindrical surface inside tubular element 18 facing box 13.

Number 22 indicates a transmission roller for strips 10 and 11, mounted on a shaft 23 parallel with the axis of pulley 7, and located underneath pulley 7 itself.

Underneath box 13, there are provided fixed transmission means for strips 10 and 11, said means consisting of an idle roller 24 mounted on a shaft 25 parallel with the axis of pulley 7.

Number 26 indicates a device for feeding the two paper strips 10 and 11 on to continuous cigarette rod forming bed 1. The said device 26 comprises an arm 27 hinged at one end to a pin 28 having its axis parallel with and underneath the axis of pulley 7. Pin 28 is supported on a wall 29 integral with front wall 2 on the machine. About pin 28 there is wound a spring 30 secured, at one end, to wall 29, and, at the other, to an appendix of pin 28. The free end of arm 27 presents an integral tubular element 31 parallel with pin 28, fitted on the front end (as viewed in FIG. 1) with a manual control means consisting of a grip knob 32, and connected, at the other end, to a suction source (not shown) via a flexible duct 33.

Figure 2:
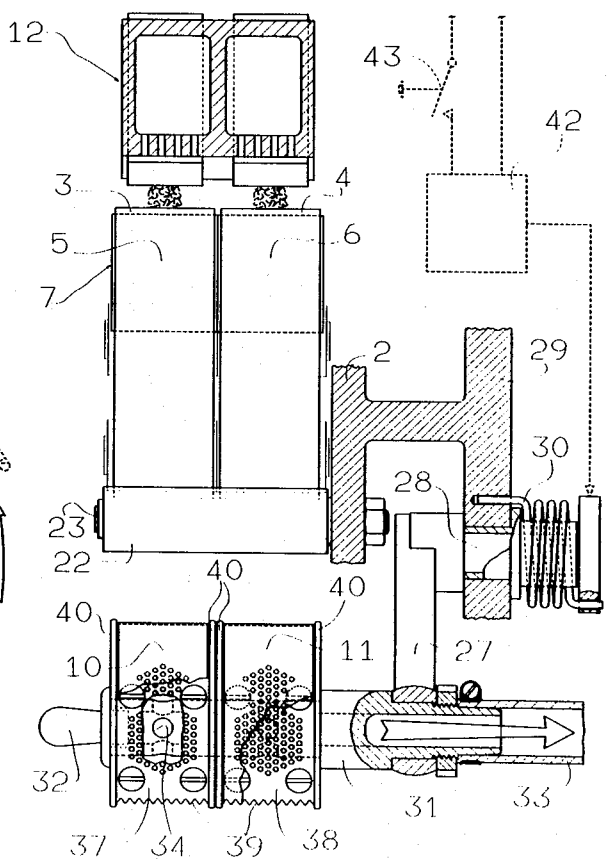
FIG. 2 shows a side view of a detail in FIG. 1.

Close to knob 32, tubular element 31 is fitted, in respective holes 34 (only one of which is shown in FIG. 2), with holding means comprising two hollow bases 35 and 36 closed off by punched, coplanar, rectangular plates 37 and 38. Bases 35 and 36 are arranged on tubular element 31 in such a manner that the vertical plane separating plates 37 and 38 coincides with the vertical intermediate plane separating belts 5 and 6.

Each of plates 37 and 38 presents a serrated cutting edge 39 at the bottom (as shown in FIG. 2) and guide edges 40 along its longitudinal edges arranged crosswise in relation to tubular element 31. Feeding device 26, which, in FIGS. 1 and 2, is shown in the bottom limit position, is designed to turn anticlockwise about pin 28 into a top limit position contrasted by spring 30 and as shown by the dotted line in FIG. 1. As shown in FIG. 1, feeding device 26 is shaped and sized so that, in the said top limit position, a concave, cylindrical surface 41 of bases 35 and 36 is arranged coaxial with pulley 7 and substantially contacting belts 5 and 6 looped about pulley 7. Such contact occurs over an arc of substantially 90° along the portion of belts 5 and 6 immediately preceding top branches 3 and 4. With feeding device 26 so arranged, plates 37 and 38 are substantially parallel with and contacting top branches 3 and 4, and present a front edge, in relation to the traveling direction of belts 5 and 6, located at the input of continuous cigarette rod forming bed 1. In actual use, and under normal operating conditions of the cigarette manufacturing machine, paper strips 10 and 11 travel along the route defined by transmission rollers 24 and 22 and pulley 18 on to continuous cigarette rod forming bed 1. Branches 3 and 4 of belts 5 and 6 provide for feeding forward strips 10 and 11 in conjunction with the said continuous streams of tobacco supplied by device 12.

Under such conditions, arm 27 of feeding device 26 is arranged in the bottom limit position. In the event of at least one of strips 10 and 11 tearing, the machine is stopped automatically, and the said suction sources are activated through holes 19 of pulley 7 and through top punched wall 14 of box 13.

The operator then places the ends of strips 10 and 11 on to plates 37 and 38 respectively, and, with the aid of serrated cutting edges 39, cuts off the ends of strips 10 and 11 projecting beyond the bottom ends of plates 37 and 38. The ends of strips 10 and 11 adhere to punched plates 37 and 38 by virtue of the suction exerted by duct 33 via tubular element 31 and holes 34. At this point, the operator grips knob 32 and turns arm 27 anticlockwise into the top limit position. During such rotation, the straight portions of strips 10 and 11 between roller 24 and plates 37 and 38 are gradually detoured by roller 22, which thus acts as a means of intercepting strips 10 and 11. As a result of the action of roller 22, the ends of strips 10 and 11 slide along plates 37 and 38, starting from the position shown by the continuous line in FIG. 1. As arm 27 continues turning, the portions of strips 10 and 11 between transmission roller 22 and plates 37 and 38 come into contact with belts 5 and 6 at pulley 7 and gradually adhere to the said belts 5 and 6 by virtue of the suction exerted through holes 19. When arm 27 reaches the top limit position, the end portions of strips 10 and 11 are located between the said cylindrical surfaces 41 of bases 35 and 36 and pulley 7, whereas the ends of the said strips, fully released from plates 37 and 38, are located over branches 3 and 4, at the input of horizontal continuous cigarette rod forming bed 1.

Arm 27 is then returned to the bottom limit position, and the machine restarted. Consequently, belts 5 and 6 are started up again for feeding strips 10 and 11 along bed 1, on to which strips 10 and 11 feed device 12 recommences supplying the said streams of tobacco.

From the foregoing description, it will be clear that the strip guide device according to the present invention provides for inserting the ends of strips 10 and 11 easily and quickly on to cigarette rod forming bed 1.

To those skilled in the art it will be clear that changes may be made to the strip guide device as described and illustrated herein without, however, departing from the scope of the present invention.

For example, instead of being activated manually by means of knob 32, feed device 26 may be activated by means of a motor or automatic control means 42 connected to pin 28 and operated by means of a switch 43.

Finally, the strip guide device according to the present invention and as described herein is particularly suitable for use on dual-rod cigarette manufacturing machines, on which the aforementioned drawbacks are especially troublesome. Nevertheless, it may obviously be used to great advantage on single-rod cigarette manufacturing machines also.

I claim:

1. In a cigarette manufacturing machine comprising a horizontal bed;

at least one belt for forming a continuous cigarette rod, said belt having a portion extending above and along said bed between a first and a second end thereof, being movable along said bed towards said second end, and being wound about a suction rotary pulley arranged at said first end;

a device for feeding a continuous stream of tobacco onto said belt portion, said tobacco feeding device extending above said first end and said pulley and defining between the stream of tobacco and the belt an input space for at least one paper strip;

a paper strip guide device for feeding at least one paper strip onto said belt portion, said strip guide device having a device for feeding an end of said paper strip to said input space, and said paper feeding device comprising means for holding said end of said strip and designed to move between a first and a second position in which said holding means are arranged away from, and respectively within, said input space.

2. A strip guide device as claimed in claim 1, wherein said paper feeding device comprises an arm supporting said holding means and hinged to a pin parallel to an axis of rotation of said pulley, and a suction source connected to said holding means.

3. A strip guide device as claimed in claim 2, wherein said holding means comprises at least one punched plate, a support base for said plate connected to said arm; said plate being connected to said suction source, and said base having an external profile mating with an external surface of said pulley when said holding means are in said second position.

4. A strip guide device as claimed in claim 3, wherein said plate is provided with first edges for guiding longitudinal edges of said strip, and a second edge for trimming said end of said strip.

5. A strip guide device as claimed in claim 1, wherein said paper feeding device comprises manual control means for moving said holding means between said two positions.

6. A strip guide device as claimed in claim 1, wherein said paper feeding device comprises automatic control means for moving said holding means between said two positions.

7. A strip guide device as claimed in claim 1, further comprising intercepting means for engaging said strip as the same is displaced by said paper feeding device moving towards said second position, and so as to cause said end of said strip to slide longitudinally along said holding means and detach itself gradually therefrom.

* * * * *